US006083997A

United States Patent [19]

Begala et al.

[11] Patent Number: 6,083,997

[45] Date of Patent: Jul. 4, 2000

[54] PREPARATION OF ANIONIC NANOCOMPOSITES AND THEIR USE AS RETENTION AND DRAINAGE AIDS IN PAPERMAKING

[75] Inventors: Arthur James Begala; Bruce A. Keiser, both of Naperville, Ill.

[73] Assignee: Nalco Chemical Company, Naperville, Ill.

[21] Appl. No.: 09/123,877

[22] Filed: Jul. 28, 1998

[51] Int. Cl.[7] ..... C01B 33/26

[52] U.S. Cl. ..... 516/79; 162/181.7; 423/328.1

[58] Field of Search ..... 423/328.1, 328.2, 423/328.3, 329.1, 330.1; 516/79, 84, 87; 106/239, 287.1

[56] References Cited

U.S. PATENT DOCUMENTS

| | | | |
|---|---|---|---|
| 2,574,902 | 11/1951 | Bechtold et al. . | |
| 3,374,180 | 3/1968 | Marotta . | |
| 3,597,253 | 8/1971 | Beschke et al. . | |
| 3,656,981 | 4/1972 | Beschke et al. . | |
| 3,920,578 | 11/1975 | Yates | 252/313 |
| 4,385,961 | 5/1983 | Svending et al. . | |
| 4,388,150 | 6/1983 | Sunden et al. . | |
| 4,643,801 | 2/1987 | Johnson . | |
| 4,753,710 | 6/1988 | Langley et al. . | |
| 4,778,667 | 10/1988 | Garvey et al. . | |
| 4,795,531 | 1/1989 | Sofia et al. . | |
| 4,871,251 | 10/1989 | Preikschat et al. . | |
| 4,913,775 | 4/1990 | Langley et al. . | |
| 4,961,825 | 10/1990 | Andersson et al. . | |
| 5,098,520 | 3/1992 | Begala . | |
| 5,185,062 | 2/1993 | Begala . | |
| 5,185,206 | 2/1993 | Rushmere . | |
| 5,368,833 | 11/1994 | Johansson et al. . | |
| 5,418,273 | 5/1995 | Dromard et al. . | |
| 5,470,435 | 11/1995 | Rushmere et al. . | |
| 5,477,604 | 12/1995 | Johansson et al. . | |
| 5,503,820 | 4/1996 | Moffett et al. . | |
| 5,595,629 | 1/1997 | Begala . | |
| 5,607,552 | 3/1997 | Andersson et al. | 162/181.6 |

OTHER PUBLICATIONS

Nordic Pulp and Paper Research Journal No. 1, pp. 15–21, 1996; "Important Properties of Colloidal Silica in Microparticulate Systems", Kjeil Andersson and Erik Lindgren.

Analytical Chemistry, vol. 28, pp. 1981–1983, 1956; "Determination of Specific Surface Area of Colloidal Silica by Titration with Sodium Hydroxide", George W. Sears, Jr.

Chemical Analysis, Modern Methods of Particle Size Analysis, vol. 73, pp. 93–116, 1984; "Particle Sizing Using Photon Correlation Spectroscopy, " Bruce B. Weiner.

J. Phys. Chem., vol. 60, pp. 955–957, 1956, "Degree of Hydration of Particles of Colloidal Silica in Aqueous Solution", R. K. Iler and R. L. Dalton.

"The Chemistry of Silica", Ralph K. Iler (John Wiley & Sons), p. 353, 1979.

Journal of Sol–Gel Science and Technology 8, pp. 17–22, 1997; "Past and Present of Sol–Gel Science and Technology", Jerzy Zarzycki.

*Primary Examiner*—Stanley S. Silverman
*Assistant Examiner*—Robert McBride
*Attorney, Agent, or Firm*—Kelly L. Cummings; Margaret M. Brumm; Thomas M. Breininger

[57] ABSTRACT

Anionic nanocomposites for use as retention and drainage aids in papermaking are prepared by adding an anionic polyelectrolyte to a sodium silicate solution and then combining the sodium silicate and polyelectrolyte solution with silicic acid.

26 Claims, No Drawings

PREPARATION OF ANIONIC NANOCOMPOSITES AND THEIR USE AS RETENTION AND DRAINAGE AIDS IN PAPERMAKING

FIELD OF THE INVENTION

This invention relates generally to the field of papermaking and, more particularly, to the preparation of anionic nanocomposites and their use as retention and drainage aids.

BACKGROUND OF THE INVENTION

In the manufacture of paper, an aqueous cellulosic suspension or slurry, is formed into a paper sheet. The slurry is generally diluted to a consistency (percent dry weight of solids in the slurry) of less than 1%, and often below 0.5%, ahead of the paper machine, while the finished sheet must have less than 6 weight percent water. Hence the dewatering aspects of papermaking are extremely important to the efficiency and cost of manufacture.

The least costly dewatering method is drainage, and thereafter more expensive methods are used, including vacuum pressing, felt blanket blotting and pressing, evaporation and the like, and any combination of such methods. Because drainage is both the first dewatering method employed and the least expensive, improvement in the efficiency of drainage will decrease the amount of water required to be removed by other methods and improve the overall efficiency of dewatering, thereby reducing the cost thereof.

Another aspect of papermaking that is extremely important to the efficiency and cost of manufacture is the retention of furnish components on and within the fiber mat being formed. The papermaking slurry represents a system containing significant amounts of small particles stabilized by colloidal forces. A papermaking furnish generally contains in addition to cellulosic fibers, particles ranging in size from about 5 to about 1000 nanometers consisting of, for example, cellulosic fines, mineral fillers (employed to increase opacity, brightness and other paper characteristics) and other small particles that generally, without the inclusion of one or more retention aids, would pass through the spaces (pores) between the cellulosic fibers in the fiber mat being formed.

Greater retention of fines, fillers, and other slurry components permits, for a given grade of paper, a reduction in the cellulosic fiber content of such paper. As pulps of lower quality are employed to reduce papermaking costs, the retention aspect of papermaking becomes even more important because the fines content of such lower quality pulps is generally greater than that of pulps of higher quality. Greater retention also decreases the amount of such substances lost to the white water and hence reduces the amount of material wastes, the cost of waste disposal and the adverse environmental effects therefrom. It is generally desirable to reduce the amount of material employed in a papermaking process for a given purpose, without diminishing the result sought. Such add-on reductions may realize both a material cost savings and handling and processing benefits.

Another important characteristic of a given papermaking process is the formation of the paper sheet produced. Formation may be determined by the variance in light transmission within a paper sheet, and a high variance is indicative of poor formation. As retention increases to a high level, for instance a retention level of 80 or 90%, the formation parameter generally declines.

Various chemical additives have been utilized in an attempt to increase the rate at which water drains from the formed sheet, and to increase the amount of fines and filler retained on the sheet. The use of high molecular weight water soluble polymers was a significant improvement in the manufacture of paper. These high molecular weight polymers act as flocculants, forming large flocs which deposit on the sheet. They also aid in the dewatering of the sheet. In order to be effective, conventional single and dual polymer retention and drainage programs require incorporation of a higher molecular weight component as part of the program. In these conventional programs, the high molecular weight component is added after a high shear point in the stock flow system leading up to the headbox of the paper machine. This is necessary because flocs are formed primarily by the bridging mechanism and their breakdown is largely irreversible and do not re-form to any significant extent. For this reason, most of the retention and drainage performance of a flocculant is lost by feeding it before a high shear point. On the other hand, feeding high molecular weight polymers after the high shear point often leads to formation problems. Thus, the feed requirements of the high molecular weight polymers and copolymers which provide improved retention often lead to a compromise between retention and formation. Accordingly, inorganic "microparticles" were developed and added to high molecular weight flocculant programs to improve performance.

Polymer/microparticle programs have gained commercial success replacing the use of polymer-only retention and drainage programs in many mills. Microparticle-containing programs are defined not only by the use of a microparticle component, but also often by the addition points of chemicals in relation to shear. In most microparticle-containing retention programs, high molecular weight polymers are added either before or after at least one high shear point. The inorganic microparticulate material is then usually added to the furnish after the stock has been flocculated with the high molecular weight component and sheared to break down those flocs. The microparticle addition re-flocculates the furnish, resulting in retention and drainage that is at least as good as that attained using the high molecular weight component in the conventional way (after shear), with no deleterious impact on formation.

One such program employed to provide an improved combination of retention and dewatering is described in U.S. Pat. Nos. 4,753,710 and 4,913,775, the disclosures of which are incorporated herein by reference. In accordance with these patents, a high molecular weight linear cationic polymer is added to the aqueous cellulosic papermaking suspension before shear is applied to the suspension, followed by the addition of bentonite after the shear application. Shearing is generally provided by one or more of the cleaning, mixing and pumping stages of the papermaking process, and the shear breaks down the large floes formed by the high molecular weight polymer into microflocs. Further agglomeration then ensues with the addition of the bentonitc clay particles.

Other such microparticle programs are based on the use of colloidal silica as a microparticle in combination with cationic starch such as that described in U.S. Pat. Nos. 4,388,150 and 4,385,961, the disclosures of which are incorporated herein by reference, or on the use of a cationic starch, flocculant, and silica sol combination such as that described in U.S. Pat. Nos. 5,098,520 and 5,185,062, the disclosures of which are also incorporated herein by reference. U.S. Pat. No. 4,643,801 discloses a method for the preparation of paper using a high molecular weight anionic water soluble polymer, a dispersed silica, and a cationic starch.

Although, as described above, the microparticle is typically added to the furnish after the flocculent and after at least one shear zone, the microparticle effect can also be observed if the microparticle is added before the flocculent and the shear zone (e.g., wherein the microparticle is added before the screen and the flocculent after the shear zone).

In a single polymer/microparticle retention and drainage aid program, a flocculant, typically a cationic polymer, is the only polymer material added along with the microparticle. Another method of improving the flocculation of cellulosic fines, mineral fillers and other furnish components on the fiber mat using a microparticle is in combination with a dual polymer program which uses, in addition to the microlarticle, a coagulant and flocculant system. In such a system a coagulant is first added, for instance a low molecular weight synthetic cationic polymer or cationic starch. The coagulant may also be an inorganic coagulant such as alum or polyaluminum chlorides. This addition can take place at one or several points within the furnish make up system, including but not limited to the thick stock, white water system, or thin stock of a machine. This coagulant generally reduces the negative surface charges present on the particles in the furnish, particularly cellulosic fines and mineral fillers, and thereby accomplishes a degree of agglomeration of such particles. The coagulant treatment is followed by the addition of a flocculent. Such a flocculant generally is a high molecular weight synthetic polymer which bridges the particles and/or agglomerates, from one surface to another, binding the particles into larger agglomerates. The presence of such large agglomerates in the furnish, as the fiber mat of the paper sheet is being formed, increases retention. The agglomerates are filtered out of the water onto the fiber web, whereas unagglomerated particles would, to a great extent, pass through such a paper web. In such a program, the order of addition of the microparticle and flocculant can be reversed successfully.

The present invention departs from the disclosures of these patents in that an anionic nanocomposite is utilized as the microparticle. As used herein, nanocomposite means the incorporation of an anionic polyelectrolyte into the synthesis of a colloidal silica. Nanocomposites are known in other fields/have been used in other applications, such as ceramics, semiconductors and reinforced plastics.

The present inventors have surprisingly discovered that anionic nanocomposites provide improved performance over other microparticle programs, and especially those using colloidal silica sols as the microparticle. The anionic nanocomposites of the invention exhibit improved retention and drainage performance in papermaking systems.

SUMMARY OF THE INVENTION

The anionic nanocomposites of the present invention are prepared by adding an anionic polyelectrolyte to a sodium silicate solution and then combining the sodium silicate and polyelectrolyte solution with silicic acid.

The resulting anionic nanocomposites exhibit improved retention and drainage performance in papermaking systems.

DETAILED DESCRIPTION OF THE INVENTION

The present invention is directed to a method of producing anionic nanocomposites for use as retention and drainage aids in papermaking. In accordance with this invention, an anionic polyelectrolyte is added to a sodium silicate solution and the sodium silicate and polyelectrolyte solution is then combined with silicic acid.

The anionic polyelectrolytes which may be used in the practice of this invention include polysulfonates, polyacrylates and polyphosphonates. The preferred anionic polyelectrolyte is naphthalene sulfonate formaldehyde (NSF) condensate. It is preferred that the anionic polyelectrolyte have a molecular weight in the range of about 500 to about 1,000,000. More preferably, the molecular weight of the anionic polyelectrolyte should be from about 500 to about 300,000, with about 500 to about 120,000 being most preferred. It is also preferred that the anionic polyelectrolyte have a charge density in the range of about 1 to about 13 milliequivalents/gram and, more preferably, in the range of about 1 to about 5 milliequivalents/gram. The anionic polyelectrolyte is added to a sodium silicate solution in an amount of from about 0.5 to about 15% by weight based on the total final silica concentration.

The sodium silicate solution containing the anionic polyelectrolyte is then combined with silicic acid. This may be done by pumping the silicic acid into the sodium silicate/polyelectrolyte solution over approximately 0.5 to 2.0 hours and maintaining the reaction temperature at about 30° C. Preferably, the ratio of the anionic polyelectrolyte to the total silica is about 0.5 to about 15%. The silicic acid is preferably prepared by contacting a dilute alkali metal silicate solution with a commercial cation exchange resin, preferably a so-called "strong acid resin," in the hydrogen form and recovering a dilute solution of silicic acid.

Rather than adding silicic acid to a sodium silicate solution containing a polyelectrolyte to produce a nanocomposite, an alternative procedure can also be used. This alternate procedure involves adding a solution of sodium silicate, also containing an anionic polyelectrolyte (or the two can be added separately), to a weak acid ion exchange resin in the hydrogen form (or partially neutralized with sodium hydroxide) to generate the nanocomposite directly without the need for an additional concentration step either by ultrafiltration or evaporation. In this case, silicic acid is generated in situ rather than being pre-formed as in the previous syntheses. The initial pH, after adding the sodium silicate/polyelectrolyte solution to the resin, is in the range of about 10.8 to 11.3 and decreases with time. Products with 12% solids and good performance characteristics can be collected in a pH range of about 9.5 to 10.0. In this case, the ratio of the anionic polyelectrolyte to the total silica is preferably about 0.5 to about 10%.

The resulting anionic nanocomposites may have a particle size over a wide range, i.e., from about 1 nanometer (nm) to about 1 micron (1000 nm), and preferably from about 1 nm to about 500 nm. The surface area of the anionic nanocomposite can also vary over a wide range. The surface area should be in the range of about 15 to about 3000 $m^2/g$ and preferably from about 50 to about 3000 $m^2/g$.

The present invention is further directed to a method of increasing retention and drainage in papermaking which comprises forming an aqueous cellulosic papermaking slurry, adding a polymer and an anionic nanocomposite to the slurry, draining the slurry to form a sheet and then drying the sheet.

An aqueous cellulosic papermaking slurry is first formed by any conventional means generally known to those skilled in the art. A polymer is next added to the slurry.

The polymers which may be added to the slurry include cationic, anionic, nonionic and amphoteric flocculants. These high molecular weight flocculants may either be completely soluble in the papermaking slurry or readily dispersible. The flocculants may have a branched or a crosslinked structure, provided they do not form objectionable "fish eyes," i.e., globs of undissolved polymer on the finished paper. The flocculants are readily available from a variety of commercial sources as dry solids, aqueous solutions, water-in-oil emulsions and dispersions of the water-soluble or dispersible polymer in aqueous brine solutions. The form of the high molecular weight flocculant used herein is not deemed to be critical provided the polymer is soluble or dispersible in the slurry. The dosage of the flocculant should be in the range of about 0.005 to about 0.2 weight percent based on the dry weight of fiber in the slurry.

An anionic nanocomposite is also added to the papermaking slurry. The anionic nanocomposite can be added either before, simultaneously with or after the flocculant addition. The point of addition depends on the type of paper furnish, e.g., kraft. mechanical, etc., as well as on the amount of other chemical additives in the system, such as starch, alum, coagulants, etc. The anionic nanocomposite is prepared in accordance with the procedure described above. The amount of anionic nanocomposite added to the slurry is preferably from about 0.0025% to about 1% by weight based on the weight of dry fiber in the slurry, and most preferably from about 0.0025% to about 0.1%.

The cellulosic papermaking slurry is next drained to form and sheet and then dried. The steps of draining and drying may be carried out in any conventional manner generally known to those skilled in the art.

Other additives may be charged to the slurry as adjuncts to the anionic nanocomposites, though it must be emphasized that the anionic nanocomposite does not require any adjunct for effective retention and drainage activity. Such other additives include, for example, cationic or amphoteric starches, conventional coagulants such as alum, polyaluminum chloride and low molecular weight cationic organic polymers, sizing agents such as rosin, alkyl ketene dimer and alkenyl succinic anhydride, pitch control agents and biocides. The cellulosic papermaking slurry may also contain pigments and/or fillers, such as titanium dioxide, precipitated and/or ground calcium carbonate, or other mineral or organic fillers.

The present invention is applicable to all grades and types of paper products including fine paper, board and newsprint, as well as to all types of pulps including, chemical pumps, thermo-mechanical pulps, mechanical pulps and groundwood pulps.

The present inventors have discovered that the anionic nanocomposites of this invention exhibit improved retention and drainage performance, and that they enhance the performance of polymeric flocculants in papermaking systems.

EXAMPLES

The following examples are intended to be illustrative of the present invention and to teach one of ordinary skill how to make and use the invention. These examples are not intended to limit the invention or its protection in any way.

The anionic nanocomposites in Examples 1–14 shown in Table 1 below were prepared using the following general procedure and varying the relative amounts of reagents.

Silicic acid was prepared following the general teaching of U.S. Pat. No. 2,574,902. A commercially-available sodium silicate available from OxyChem, Dallas, Tex. having a silicon dioxide content of about 29% by weight and a sodium oxide content of about 9% by weight was diluted with deionized water to a silicon dioxide concentration of 8–9% by weight. A cationic exchange resin such as Dowex IIGR-W2H or Monosphere 650C, both available from Dow Chemical Company, Midland, Mich. was regenerated to the H-form via treatment with mineral acid following well-established procedures. The resin was rinsed following regeneration with deionized water to insure complete removal of excess regenerant. The dilute silicate solution was then passed through a column of the regenerated washed resin. The resultant silicic acid was collected.

Simultaneously, an appropriate amount of sodium silicate, deionized water and an anionic polyelectrolyte was combined to form a "heel" for the reaction. For purposes of comparison, the anionic polyelectrolyte was in some cases omitted from this "heel."

The following polyelectrolytes were utilized in the preparation of the anionic nanocomposites:

1. Naphthalene sulfonic acid (sodium salt) formaldehyde condensate (NSF)—This polymer is supplied commercially by a number of chemical companies including Rohn & Haas, Hampshire Chemical Corp. and Borden & Remington Corp. The polymer has a very broad molecular weight distribution which includes dimer, trimer, tetramer, etc. oligomers and, dependent upon the source, has a weight average molecular weight of 8,000–35,000. The measured intrinsic viscosities (IV's) range from 0.036 to 0.057 dl/g and the anionic charge is 4.1 meq/g.

2. 8677Plus (B5S189B)—Poly(co-acrylamide/acrylic acid) (AcAm/AA 1/99 mole %) copolymer. The intrinsic viscosity (IV) is 1.2 dl/g corresponding to a molecular weight of 250,000 daltons. The polymer, when fully neutralized, has a charge of 13.74 meq/g.

3. Poly(acrylamidomethylpropane sulfonic acid, sodium salt), (polyAMPS)—This homopolymer has an IV of 0.51 dl/g and an anionic charge of 4.35 meq/g.

4. Poly(co-acrylamide/AMPS, sodium salt) 50/50 mole %—This copolymer has an IV of 0.80 dl/g and an anionic charge of 3.33 meq/g.

Freshly prepared silicic acid was then added to the "heel" with agitation at 30° C. Agitation was continued for 60 minutes after complete addition of the silicic acid. The resulting anionic nanocomposite may be used immediately, or stored for later use.

After preparation of the anionic nanocomposite, it is often advantageous to concentrate the product to a higher silica level. In the present invention, this was done using a semi-permeable ultrafiltration membrane which allowed water and low molecular weight electrolytes to pass through the membrane but retained colloidal silica and higher molecular weight polymer. Accordingly, composites made at silica concentrations of 5–7 wt % could be concentrated to 10–14 (or higher) wt % silica.

In Examples 15 and 16, the alternate synthesis procedure was employed and a further concentration step was not required.

TABLE I

| Anionic Nanocomposites | | | | | | | |
|---|---|---|---|---|---|---|---|
| Example | Polyelectrolyte (PE) | Silica/Na2O | Silica wt % | PE/silica wt/wt | Surface Area m2/gram | "S" value % | Mean size nm |
| 1 | 1 | 17.2 | 7.1 | 0.077 | | | |
| 2 | 1 | 17.2 | 7.1 | 0.0385 | | | |
| 3 | none | 17.2 | 7.1 | na | | | |
| 4 | 1 | 17.2 | 10 | 0.065 | | | |

TABLE I-continued

| Anionic Nanocomposites | | | | | | | |
|---|---|---|---|---|---|---|---|
| Example | Polyelectrolyte (PE) | Silica/Na2O | Silica wt % | PE/silica wt/wt | Surface Area m2/gram | "S" value % | Mean size nm |
| 4a | 1 | 17.2 | 12 | 0.06 | | | |
| 5 | none | 17.2 | 14.1 | na | | | |
| 6 | 1 | 17.6 | 12 | 0.06 | 776 | | 23.2 |
| 7 | 1 | 17.6 | 11 | 0.072 | 790 | 38.1 | 20.5 |
| 8 | 1 | 19.7 | 12 | 0.061 | | 29.7 | |
| 9 | 1 | 22 | 12 | 0.066 | | 18.1 | |
| 9a | 1 | 22 | 11 | 0.066 | | 26 | |
| 10 | 3 | 17.2 | 12 | 0.078 | | | |
| 11 | 4 | 17.2 | 12 | 0.078 | | | |
| 12 | 2 | 17.6 | 5.7 | 0.0264 | | | |
| 13 | 2 | 17.6 | 5.7 | 0.0519 | | | |
| 14 | none | 17.6 | 5.7 | na | | | |
| 15 | 1 | na | 12.3 | 0.035 | 970 | 24.0 | 25.1 |
| 16 | 1 | na | 12.1 | 0.035 | 943 | 28.2 | 19.5 |

Preparation of Synthetic Standard Furnishes

Alkaline Furnish—The alkaline furnish has a pH of 8.1 and is composed of 70 weight percent cellulosic fiber and 30% weight percent filler diluted to an overall consistency of 0.5% by weight using synthetic formulation water. The cellulosic fiber consists of 60% by weight bleached hardwood kraft and 40% by weight bleached softwood kraft. These are prepared from dry lap beaten separately to a Canadian Standard Freeness (CSF) value ranging from 340 to 380 CSF. The filler was a commercial ground calcium carbonate provided in dry form. The formulation water contained 200 ppm calcium hardness (added as $CaCl_2$), 152 ppm magnesium hardness (added as $MgSO_4$), and 110 ppm bicarbonate alkalinity (added as $NaHCO_3$)

Acid Furnish—The acid furnish consisted of the same bleached kraft hardwood/softwood weight ratio, i.e., 60/40. The total solids of the furnish comprised 92.5% by weight cellulosic fiber and 7.5% by weight filler. The filler was a combination of 2.5% by weight titanium dioxide and 5.0 percent by weight kaolin clay. Other additives included alum dosed at 20 lbs active per ton dry solids. The pH of the furnish was adjusted with 50% sulfuric acid such that the furnish pH was 4.8 after alum addition.

Britt Jar Test

The Britt Jar Test used a Britt CF Dynamic Drainage Jar developed by K. W. Britt of New York University, which generally consists of an upper chamber of about 1 liter capacity and a bottom drainage chamber, the chambers being separated by a support screen and a drainage screen. Below the drainage chamber is a flexible tube extending downward equipped with a clamp for closure. The upper chamber is provided with a 2-inch, 3-blade propeller to create controlled shear conditions in the upper chamber. The test was done following the sequence below:

TABLE 2

| Alkaline Furnish Test Protocol | | |
|---|---|---|
| Time (seconds) | Agitator Speed (rpm) | Action |
| 0 | 750 | Commence shear via mixing-Add cationic starch. |
| 10 | 1500 | Add Flocculant. |
| 40 | 750 | Reduce the shear via mixing speed. |
| 50 | 750 | Add the microparticle. |

TABLE 2-continued

| Alkaline Furnish Test Protocol | | |
|---|---|---|
| Time (seconds) | Agitator Speed (rpm) | Action |
| 60 | 750 | Open the tube clamp to commence drainage. |
| 90 | 750 | Stop draining. |

TABLE 3

| Acid Furnish Test Protocol | | |
|---|---|---|
| Time (seconds) | Agitator Speed (rpm) | Action |
| 0 | 750 | Commence shear via mixing. Add cationic starch and alum. |
| 10 | 1500 | Add Flocculant. |
| 40 | 750 | Reduce the shear via mixing speed. |
| 50 | 750 | Add the microparticle. |
| 60 | 750 | Open the tube clamp to commence drainage. |
| 90 | 750 | Stop draining. |

In all of the above cases, the starch used was Solvitose N, a cationic potato starch, commercially available from Nalco Chemical Company. In the case of the alkaline furnish, the cationic starch was introduced at 10 lbs/ton dry weight of furnish solids or 0.50 parts by weight per hundred parts of dry stock solids, while the flocculant was added at 6 lbs duct/ton dry weight of furnish solids or 0.30 parts by weight per hundred parts of dry stock solids. In the case of the acid furnish, the additive dosages were: 20 lbs/ton dry weight of furnish solids of active alum (i.e., 1.00 parts by weight per hundred parts of dry stock solids), 10 lbs/ton dry weight of furnish solids or 0.50 parts by weight per hundred parts of dry stock solids of cationic starch, and the flocculant was added at 6 lbs product/ton dry weight of furnish solids or 0.30 parts by weight per hundred parts of dry stock solids.

The material so drained from the Britt Jar (the "filtrate") was collected and diluted with water to provide a turbidity which could be measured conveniently. The turbidity of such diluted filtrate, measured in Nephelometric Turbidity Units or NTUs, was then determined. The turbidity of such a filtrate is inversely proportional to the papermaking retention performance, i.e., the lower the turbidity value, the higher the retention of filler and/or fines. The turbidity values were determined using a Hach Turbidimeter. In some cases, instead of measuring turbidity, the % Transmittance (% T) of the sample was determined using a DigiDisc Photometer. The transmittance is directly proportional to papermaking retention performance, i.e., the higher the transmittance value, the higher the retention value.

First Pass Ash retention (FPAR) is a measure of the degree of incorporation of filler into the formed sheet. It is calculated from the filler consistencies in the initial paper making slurry or Britt Jar furnish $C_{fs}$ and filler consistency in the white water or Britt Jar filtrate $C_{fww}$ resulting during the sheet formation:

$$FPAR=((C_{fs}-C_{fww})/C_{fs})\times 100\%$$

Scanning Laser Microscogy

The Scanning Laser Microscopy (SLM) employed in the following examples is outlined in U.S. Pat. No. 4,871,251 and generally consists of a laser source, optics to deliver the incident light to and retrieve the scattered light from the furnish, a photodiode, and signal analysis hardware. Commercial instruments are available from Lasentec™, Redmond, Wash.

The experiment consists of taking 300 mL of cellulose fiber containing slurry and placing it in the appropriate mixing beaker. Shear is provided to the furnish via a variable speed motor and propeller. The propeller is set at a fixed distance from the probe window to ensure slurry movement across the window. A typical dosing sequence is shown below.

TABLE 4

| Scanning Laser Microscopy Test Protocol | |
|---|---|
| Time (minutes) | Action |
| 0 | Commence mixing. Record baseline floc size. |
| 1 | Add cationic starch. Record floc size change. |
| 2 | Add flocculant. Record floc size change. |
| 4 | Add the microparticle. Record floc size change. |
| 7 | Terminate experiment. |

The change in mean chord length of the flocs present in the furnish relates to papermaking retention performance, i.e., the greater the change induced by the treatment, the higher the retention value. The mean chord length is proportional to the floe size which is formed and its rate of decay is related to the strength of the floc. In all of the cases discussed herein, the flocculant was a 10 mole % cationic polyacrylamide dosed at a concentration of 1.56 lbs/ton (oven dried furnish).

Surface Area Measurement

Surface area reported herein is obtained by measuring the adsorption of base on the surface of sol particles. The method is described by Sears in *Analytical Chemistry*, 28(12), 1981–1983 (1956). As indicated by Iler ("The Chemistry of Silica," John Wiley & Sons, 1979, 353), it is the "value for comparing relative surface areas of particle sizes in a given system which can be standardized." Simply put, the method involves the titration of surface silanol groups with a standard solution of sodium hydroxide, of a known amount of silica (i.e., grams), in a saturated sodium chloride solution. The resulting volume of titrant is converted to surface area.

S-value Determination

Another characteristic of colloids in general is the amount of space occupied by the dispersed phase. One method for determining this was first developed by R. Iler and R. Dalton and reported in *J. Phys. Chem.*, 60 (1956), 955–957. In colloidal silica systems, they showed that the S-value relates to the degree of aggregation formed within the product. A lower S-value indicates a greater volume is occupied by the same weight of colloidal silica.

DLS Particle Size Measurement

Dynanic Light Scattering (DLS) or Photon Correlation Spectroscopy (PCS) has been used to measure particle size in the submicron range since as early as 1984. An early treatment of the subject is found in "Modern Methods of Particle Size Analysis," Wiley, New York, 1984. The method consists of filtering a small volume of the sample through a 0.45 micron membrane filter to remove stray contamination such as dust or dirt. The sample is then placed in a cuvette which in turn is placed in the path of a focused laser beam. The scattered light is collected at 90° to the incident beam and analyzed to yield the average particle size. The present work used a Coulter® N4 unit, commercially available from Coulter Corporation of Miami, Fla.

Example 1

The silicic acid, the preparation of which was described above (as 6.55% silica), in the amount of 130.1 grams was added to a 18.81 gram "heel" of an aqueous solution containing sodium silicate, 10.90 wt % as $SiO_2$, and a sodium naphthalene sulfonate formaldehyde condensate polymer (NSF) at 4.35 wt %. This addition was carried out over a half hour period at 30±0.5° C. while constantly stirring the reaction mixture. The final product solution contained a colloidal silica material as 7.1 wt % $SiO_2$ and the NSF polymer at 0.549 wt %. The ratio of $SiO_2/Na_2O$ was 17.2 and $NSF/SiO_2$ was 0.077.

Example 2

The procedure of Example 1 was followed except in this case the "heel" contained 2.175 wt % of the NSF polymer. In this instance, the $NSF/SiO_2$ ratio was 0.0385.

Example 3

The procedure of Example 1 was followed except in this case the "heel" did not contain any of the NSF polymer. This sample was used as a "blank" reaction to compare the effect of the NSF polymer.

The anionic nanocomposites of Examples 1–3 were compared to a standard commercial colloidal silica, Nalco® 8671, as sold by Nalco Chemical Company, by measuring Britt Dynamic Drainage Jar (DDJ) retentions. The activity was determined by the level of filtrate turbidity from the DDJ and these results are shown below in Table 5.

As illustrated in Table 5, at a dosage of 0.5 lbs/ton silica, the nanocomposites were more effective than the commercial silica by 130, 68 and 0 percent for Examples 1, 2 and 3, respectively. Similarly, at 1 lb/ton silica, the respective improvements were 69, 54 and 22 percent. Also, Examples 1 and 2 were more effective at 1 lb/ton than the commercial product was at 2 lbs/ton. Thus, the products prepared containing a polyelectrolyte (Examples 1 and 2) demonstrated greater improvements over the product that did not contain a polyelectrolyte (Example 3). In addition, it can be seen that the nanocomposite of Example 1, which contained a higher amount of polyelectrolyte, was more efficient than the nanocomposite of Example 2.

TABLE 5

| Active Product Dosage lb/ton | Alkaline Furnish pH 7.8 DDJ Filtrate Turbidity/3 NTU | | | | Turbidity Reduction % | | | |
|---|---|---|---|---|---|---|---|---|
| | Commercial Silica | Example 1 | Example 2 | Example 3 Blank | Commercial Silica | Example 1 | Example 2 | Example 3 |
| 0.0 | 353 | 353 | 353 | 353 | 0.0 | 0.0 | 0.0 | 0.0 |
| 0.25 | 340 | 225 | 290 | 315 | 3.7 | 36.3 | 17.8 | 10.8 |
| 0.5 | 289 | 185 | 230 | 280 | 20.7 | 47.6 | 34.8 | 20.7 |
| 1.0 | 195 | 85 | 110 | 160 | 44.8 | 75.9 | 68.8 | 54.7 |
| 2.0 | 130 | | | | 63.2 | | | |

Example 4

The procedure of Example 1 was followed except in this instance the reacted product was concentrated to 10 and 12.0 wt % $SiO_2$ by using an ultrafiltration membrane in a stirred cell assembly. The membrane employed had a molecular weight cut-off of 100,000 (Amicon Y-100). As a result of this cut-off range there was a 23.1 wt % loss of the NSF polymer through the membrane and the final NSF/$SiO_2$ ratio was 0.065 at 10 wt % silica and 0.060 at 12 wt % silica.

Example 5

The procedure of Example 3 was followed except in this instance the reacted product was concentrated to 14.1 wt % $SiO_2$ by using an ultrafiltration membrane in a stirred cell assembly. The membrane employed had a molecular weight cut-off of 100,000 (Amicon Y-100).

The products of Examples 4 and 5 were compared to a standard commercial colloidal silica, Nalco® 8671, by measuring DDJ retentions. The activity was determined by the level of filtrate turbidity from the DDJ and the results are shown below in Table 6. Determination of calcium carbonate ash in the DDJ furnish and filtrate also allowed a first pass ash retention (FPAR) value to be calculated. These data are proportional to the turbidity values and are shown in Table 7.

TABLE 7-continued

| Active Product | Alkaline Furnish pH 7.8 First Pass Ash Retention % | | | |
|---|---|---|---|---|
| Dosage lb/ton | Commercial Silica | Example 4 10% Silica | Example 4a 12% Silica | Example 5 Blank |
| 0.5 | 52.4 | 64.0 | 66.1 | 58.0 |
| 1.0 | 67.1 | 74.9 | 73.3 | 65.3 |
| 2.0 | 72.5 | | | |

Example 6

The procedure of Example 1 was followed with silicic acid in the amount of 1621 grams added to 229 grams of an aqueous solution containing sodium silicate, 10.89 wt % as $SiO_2$, and a sodium naphthalene sulfonate formaldehyde condensate polymer (NSF) at 4.46 wt %. This addition was carried out over a one hour period at 30±0.5° C. while constantly stirring the reaction mixture. The final product solution contained a colloidal silica material as 7.1 wt % $SiO_2$ the NSF polymer at 0.557 wt %. The ratio of $SiO_2$/$Na_2O$ was 17.6 and NSF/$SiO_2$ was 0.0785.

The above-reacted product was then concentrated to 12.0 wt % $SiO_2$ by using an ultrafiltration membrane in a stirred cell assembly. The membrane employed had a molecular weight cut-off of 100,000 (Amicon Y-100). As a result of this cut-off range there was a 23.1 wt % loss of the NSF polymer through the membrane and the final NSF/$SiO_2$ ratio was 0.06.

The product both prior to and after ultrafiltration was characterized with respect to surface area by employing the titration procedure of G.W. Sears, *Analytical Chemistry*, 28, (1956), p. 1981. The areas obtained were 822 and 776 $m^2/g$, respectively.

The product of Example 6 was compared to a standard commercial colloidal silica, Nalco® 8671, by measuring

TABLE 6

| Active Product | Alkaline Furnish pH 7.8 DDJ Filtrate Turbidity/3 NTU | | | | Turbidity Reduction % | | | |
|---|---|---|---|---|---|---|---|---|
| Dosage lb/ton | Commercial Silica | Example 4 10% Silica | Example 4a 12% Silica | Example 5 Blank | Commercial Silica | Example 4 10% Silica | Example 4a 12% Silica | Example 5 |
| 0.0 | 345 | 345 | 345 | 345 | 0.0 | 0.0 | 0.0 | 0.0 |
| 0.25 | 330 | 268 | 260 | 330 | 4.3 | 22.3 | 24.6 | 4.3 |
| 0.5 | 295 | 223 | 210 | 260 | 14.5 | 35.4 | 39.1 | 24.6 |
| 1.0 | 204 | 155 | 165 | 215 | 40.9 | 55.1 | 52.2 | 37.7 |
| 2.0 | 170 | | | | 50.7 | | | |

TABLE 7

| Active Product | Alkaline Furnish pH 7.8 First Pass Ash Retention % | | | |
|---|---|---|---|---|
| Dosage lb/ton | Commercial Silica | Example 4 10% Silica | Example 4a 12% Silica | Example 5 Blank |
| 0.0 | 44.3 | 44.3 | 44.3 | 44.3 |
| 0.25 | 46.8 | 56.7 | 58.0 | 46.8 |

DDJ retentions. The activity was determined by the level of filtrate turbidity from the DDJ and the results are shown below in Table 8.

TABLE 8

| Active Product | | | | Turbidity Reduction % | | |
|---|---|---|---|---|---|---|
| Dosage lb/ton | Commercial Silica | Example 6 12% | Example 4a 12.00% | Commercial Silica | Example 6 12% | Example 4a 12.00% |
| | Alkaline Furnish pH 7.8 DDJ Filtrate/3 NTU | | | | | |
| 0.0 | 351 | 351 | 351 | 0.0 | 0.0 | 0.0 |
| 0.25 | 340 | 292 | 308 | 3.1 | 16.8 | 12.3 |
| 0.5 | 285 | 220 | 260 | 18.8 | 37.3 | 25.9 |
| 1.0 | 220 | 150 | 145 | 37.3 | 57.3 | 58.7 |
| 2.0 | 155 | | | 55.8 | | |
| | Acid Furnish pH 4.8 DDJ Filtrate Turbidity/3 NTU | | | | | |
| 0.0 | 394 | 394 | 394 | 0.0 | 0.0 | 0.0 |
| 0.5 | 330 | | | 16.2 | | |
| 1.0 | 355 | 315 | 255 | 9.9 | 20.0 | 35.3 |
| 2.0 | 295 | 255 | 215 | 25.1 | 35.3 | 45.4 |
| 3.0 | 280 | 193 | 150 | 28.9 | 51.0 | 49.0 |
| 4.0 | 230 | 200 | 170 | 41.6 | 49.2 | 56.8 |

Example 7

In a larger preparation, similar to Example 6 above, 3285 lbs of silicic acid (5.91%) were added to 419.6 lbs of an aqueous solution containing sodium silicate, 10.89% as $SiO_2$, and a NSF polymer at 4.49 wt %. The final product solution contained a colloidal silica material as 6.47 wt % $SiO_2$ and the NSF polymer at 0.508 wt %. The ratio of $SiO_2/Na_2O$ was 17.6 and $NSF/SiO_2$ was 0.0785.

The above-reacted product was then concentrated to 11.0 wt % $SiO_2$ by using an ultrafiltration membrane in a tube flow assembly. The membrane employed had a molecular weight cut-off of 10,000. As a result of this cut-off range, there was a 6.5 wt % loss of the NSF polymer through the membrane and the final $NSF/SiO_2$ ratio was 0.072.

Example 8

In this case, the ratio of silicic acid to sodium silicate was increased to yield a $SiO_2/Na_2O$ ratio of 19.7. The silicic acid (6.59 wt % as $SiO_2$) in the amount of 1509 grams was added to 169.4 grams of an aqueous solution containing sodium silicate, 12.04 wt % as $SiO_2$, and a NSF polymer at 4.60 wt %. This addition was carried out over a one hour period at 30±0.5° C. while constantly stirring the reaction mixture. The final product solution contained a colloidal silica material as 7.14 wt % $SiO_2$ and the NSF polymer at 0.465 wt %. The ratio of $SiO_2/Na_2O$ was 19.7 and $NSF/SiO_2$ was 0.065.

The above-reacted product was then concentrated to 12.0 wt % $SiO_2$ by using an ultrafiltration membrane in a stirred cell assembly. The membrane employed had a molecular weight cut-off of 10,000. As a result of this cut-off range there was a 7.2 wt % loss of the NSF polymer through the membrane and the final $NSF/SiO_2$ ratio was 0.061.

Example 9

In this case, a further increase in the $SiO_2/Na_2O$ ratio was made to 22.0. Silicic acid (6.55 wt % as $SiO_2$) in the amount of 1546 grams was added to 135.7 grams of an aqueous solution containing sodium silicate, 13.4 wt % as $SiO_2$, and a NSF polymer at 5.77 wt %. This addition was carried out over a one hour period at 30±0.5° C. while constantly stirring the reaction mixture. The final product solution contained a colloidal silica material as 7.10 wt % $SiO_2$ and the NSF polymer at 0.465 wt %. The ratio of $SiO_2/Na_2O$ was 22.0 and $NSF/SiO_2$ was 0.0655.

The above-reacted product was then concentrated to both 11.0 and 12.0 wt % $SiO_2$ by using an ultrafiltration membrane in a stirred cell assembly. The membrane employed had a molecular weight cut-off of 10,000. As a result of this cut-off range, there was a 7. 2 wt % loss of the NSF polymer through the membrane and the final $NSF/SiO_2$ ratio was 0.066 in both cases.

TABLE 9

| | SLM Results Acid Furnish | |
|---|---|---|
| Compound | Delta @ Maximum (microns) @ 2 lb. Active Product/t | Improvement % vs. Nalco ® 8671 |
| Commercial Silica (8671) | 13.7 | |
| Example 7 | 32.3 | 136 |
| Example 8 | 44.9 | 228 |
| Example 9 (12%) | 50.9 | 272 |
| Example 9a (11%) | 41.6 | 204 |
| Bentonite | 29.9 | 118 |

The data in Table 9 were obtained by measuring the relative floe size (mean chord length, MCL) increase upon the addition of the nanocomposites of each of the Examples after the addition of a cationic flocculent. In the experiment, a sufficient time period (45 seconds to two minutes) was allowed for the floc formed by the cationic polymer to be degraded due to the shearing action of the mixing propeller. At that time, the nanocomposite of the Example was added to the furnish and a further increase in floe size was observed. The maximum change in floc size, before degradation of the microparticle induced floc structure due to stirring occurred (denoted as Delta @ Maximum), was measured as a function of concentration for the commercial silica and bentonite, as well as for the nanocomposites of the Examples. The larger this increase in mean chord length, the more efficient the microparticle was at retaining the furnish components in a papermaking process.

The percent improvement vs. Nalco® 8671 was calculated as follows: Change in MCL(Product)−Change in MCL (Nalco® 8671)/Change in MCL (Nalco® 8671)

As shown in Table 9, the nanocomposite samples were anywhere from 136 to 272% more effective than the commercial silica under these acid furnish conditions. They were also more active than the bentonite sample, which was also used as a microparticle.

Example 10

In this Example, the sodium salt of a homopolymer of acrylamidomethylpropane sulfonic acid, AMPS, (polyelectrolyte 3) was used to form a nanocomposite with colloidal silica.

A 6.55 wt % solution of silicic acid was prepared as described above. It was added in the amount of 130 grams to 16.56 grams of an aqueous solution containing sodium silicate, 12.41 wt % as $SiO_2$, and the AMPS polymer at 4.98 wt %. This addition was carried out over a half hour period at 30±0.5° C. while constantly stirring the reaction mixture. The final product solution contained a colloidal silica material as 7.2 wt % $SiO_2$ and the AMPS polymer at 0.563 wt %. The ratio of PolyAMPS/$SiO_2$ was 0.0780.

The above-reacted product was then concentrated to 12.09 wt % $SiO_2$ by using a YM-100 ultrafiltration membrane in a stirred cell assembly.

Example 11

A copolymer of sodium AMPS and acrylamide (50/50 mole %) (polyclectrolyte 4) was employed to form a nanocomposite with colloidal silica following the same procedure described in Example 10.

The products of Examples 10 and 11 were tested in a standard alkaline furnish by measuring DDJ retentions. The activity was determined by the level of filtrate turbidity from the DDJ and the results are shown below in Table 10.

Example 12

Silicic acid, the preparation of which is described above (as 4.90% silica), in the amount of 122.4 grams was added to a 7.25 gram "heel" of an aqueous solution containing sodium silicate, 19.25 wt % as $SiO_2$, and a poly(co-acrylamide/acrylic acid, sodium salt) (1/99 mole%) (polyelectrolyte 2) at 2.7 wt %. This addition was carried out over a half hour period at 30±0.5° C. while constantly stirring the reaction mixture. The final product solution contained a colloidal silica material as a 5.7 wt % $SiO_2$ and polyelectrolyte 2 at 0.151 wt %. The ratio of $SiO_2/Na_2O$ was 17.6 and polyelectrolyte 2/$SiO_2$ was 0.0264.

Example 13

The procedure of Example 12 was followed except in this case the "heel" contained 3.67 wt % of polyelectrolye 2. The polyelectrolyte 2/$SiO_2$ ratio was 0.0519.

Example 14

The procedure of Example 12 was followed except in this case the "heel" did not contain any of polyelectrolyte 2. This sample was used as a "blank" reaction to compare the effect of polyelectrolyte 2.

The products of the Examples 12–14 were compared to a standard commercial colloidal silica, Nalco® 8671, by measuring DDJ retentions. The activity was determined by the level of filtrate turbidity from the DDJ and these results are shown below in Table 11.

TABLE 10

| Active Product | Alkaline Furnish pH 7.8 DDJ Filtrate Turbidity/3 NTU | | | Turbidity Reduction % | | |
|---|---|---|---|---|---|---|
| Dosage lb/ton | Commercial Silica | Example 10 12% | Example 11 12% | Commercial Silica | Example 10 12% | Example 11 12% |
| 0.0 | 298 | 298 | 298 | 0.0 | 0.0 | 0.0 |
| 0.25 | 285 | 275 | 225 | 4.3 | 7.7 | 24.5 |
| 0.5 | 238 | 220 | 195 | 20.1 | 26.2 | 34.6 |
| 1.0 | 205 | 145 | 135 | 31.2 | 51.3 | 54.7 |
| 2.0 | 163 | | | 45.3 | | |

TABLE 11

| Active Product | Alkaline Furnish pH 7.8 DDJ Filtrate Turbidity/3 NTU | | | | Turbidity Reduction % | | | |
|---|---|---|---|---|---|---|---|---|
| Dosage lb/ton | Commercial Slica | Example 12 | Example 13 | Example 14 Blank | Commercial Silica | Example 12 | Example 13 | Example 14 Blank |
| 0.0 | 344 | 344 | 344 | 344 | 0.0 | 0.0 | 0.0 | 0.0 |
| 0.25 | | 305 | 330 | 300 | | 11.3 | 4.1 | 12.8 |
| 0.5 | 325 | 230 | 250 | 290 | 5.5 | 33.1 | 27.3 | 15.7 |
| 1.0 | 220 | 170 | 145 | 225 | 36.0 | 50.6 | 57.8 | 34.6 |
| 2.0 | 170 | 120 | | 160 | 50.6 | 65.1 | | 53.5 |

Examples of an alternate synthesis procedure employing a weak acid ion-exchange resin are described below, along with the performance data of the final products.

Example 15

A weak acid ion-exchange resin, IRC 84 (Rohm & Haas), in the hydrogen form was first converted to the sodium form and then a 5% HC1 solution was added to convert 75% of the resin to the hydrogen form (with 25% remaining in the sodium form). A given volume of the wet resin, 470 ml, containing 1137 milliequivalents in the hydrogen form was then added to a 2 liter resin flask. The flask was equipped with a stirrer, baffles and a pH electrode to monitor the exchange of the sodium ion. The IRC 84 resin and 447 grams of deionized water were then added to the flask. A mixture of sodium silicate (1197 meq.–120.9 grams as $SiO_2$) and NSF polyanion, polyelectrolyte 1, (4.23 grams) as a 20% silicate solution (604.4 grams total) were added to the resin flask over a 13 minute period. The total $SiO_2$ concentration was about 11.5% in the flask and the pH of the resin containing solution increased from 7.5 to 11.1 after addition of the silicate/NSF solution. The pH was then monitored with time. After two hours, the pH decreased from 11.1 to 9.8 and the solution was removed from the resin by filtration.

Example 16

The same procedure as used above in Example 16 was followed except that the reaction was terminated at pH 10.0 after 80 minutes of reaction.

TABLE 12

SLM Results - Alkaline Furnish

| Compound | Delta @ Maximum (microns) @ 2 lb. product/t | Improvement % vs. 8671 |
|---|---|---|
| Commercial Silica (Nalco ® 8671) | 12.8 | |
| Example 15 | 58.9 | 360 |
| Example 16 | 53.4 | 317 |

The results in Table 12 were obtained using Scanning Laser Microscopy (SLM) and were analyzed in the same manner as described above in Example 9. The nanocomposite products produced by the alternate silica process showed better performance than the nanocomposite products in Example 9.

Example 17

In addition to the results shown above for the preparation of colloidal silica in the presence of polyelectrolytes, the performance of a pre-formed colloidal silica can also be enhanced by the addition of a polyelectrolyte to the silica product after its synthesis.

To 87.47 grams of a commercial colloidal silica, Nalco® 8671, were added 9.72 grams of deionized water and 2.82 grams of a solution of polyelectrolyte 1 containing 1.01 grams of the NSF polymer. The resulting blend contained 13.0 wt % silica and a polyelectrolyte/silica ratio of 0.077.

DDJ testing was then performed on an alkaline furnish comparing the blended product, the unblended silica, and an experiment in which the the silica and NSF polyelectrolyte were added separately but simultaneously to the DDJ. The blended product was more efficient in its retention performance than either the commercial silica or the separately added components.

TABLE 13

| Active | Alkaline Furnish pH 7.8 DDJ Filtrate Tubridity/3 NTU | | | Turbidity Reduction % | | |
|---|---|---|---|---|---|---|
| Product Dosage lb/ton | Commercial Silica | Example 15 | Commercial Silica Plus NSF PE separately | Commercial Silica | Example 15 | Commercial Silica Plus NSF PE separately |
| 0.0 | 392 | 392 | 392 | 0.0 | 0.0 | 0.0 |
| 0.25 | 365 | 330 | | 6.9 | 15.8 | |

TABLE 13-continued

| Active | Alkaline Furnish pH 7.8 DDJ Filtrate Tubridity/3 NTU | | | Turbidity Reduction % | | |
|---|---|---|---|---|---|---|
| Product Dosage lb/ton | Commercial Silica | Example 15 | Commercial Silica Plus NSF PE separately | Commercial Silica | Example 15 | Commercial Silica Plus NSF PE separately |
| 0.5 | 340 | 282 | 343 | 13.3 | 28.1 | 12.5 |
| 1.0 | 241 | 193 | 216 | 38.5 | 50.8 | 44.9 |
| 1.5 | 183 | 122 | 168 | 53.3 | 68.9 | 57.1 |
| 2.0 | 145 | | | 63.0 | | |

The DDJ data in Table 13 illustrate the improvement seen when a preformed mixture of colloidal silica and polyelectrolyte 1 is used vs. silica alone or the addition of silica and the polyelectrolyte separately. This is additional evidence that a complex or composite is formed between the polyelectrolyte and silica and that the effect seen is not simply an additive one between the two components.

While the present invention is described above in connection with preferred or illustrative embodiments, these embodiments are not intended to be exhaustive or limiting of the invention. Rather, the invention is intended to cover all alternatives, modifications and equivalents included within its spirit and scope, as defined by the appended claims.

What is claimed is:

1. A method of producing an anionic nanocomposite for use as a retention and drainage aid in papermaking comprising the steps of:

a) providing a sodium silicate solution;

b) adding an anionic polyelectrolyte to the sodium silicate solution; and c) combining the sodium silicate solution containing the anioinic polyelectrolyte with silicic acid.

2. The method of claim 1 wherein the anionic polyelectrolyte is selected from the group consisting of polysulfonates, polyacrylates and polyphosphonates.

3. The method of claim 2 wherein the anionic polyelectrolyte is naphthalene sulfonate formaldehyde condensate.

4. The method of claim 1 wherein the anionic polyelectrolyte has a molecular weight of from about 500 to about 1,000,000.

5. The method of claim 1 wherein the anionic polyelectrolyte has a molecular weight of from about 500 to about 300,000.

6. The method of claim 1 wherein the anionic polyelectrolyte has a molecular weight of from about 500 to about 120,000.

7. The method of claim 1 wherein the anionic polyelectrolyte has a charge density of m about 1 to about 13 milliequivalents/gram.

8. The method of claim 1 wherein the anionic polyelectrolyte has a charge density of from about 1 to about 5 milliequivalents/gram.

9. The method of claim 1 wherein the anionic polyelectrolyte is added to the sodium silicate solution in an amount of from about 0.5 to about 15% by weight based on the total final silica concentration.

10. The method of claim 1 wherein the silicic acid is combined with the sodium silicate solution containing the anionic polyelectrolyte by adding the silicic acid to the solution.

11. The method of claim 10 wherein the ratio of the anionic polyelectrolyte to the total silica is about 0.5 to about 15%.

12. The method of claim 1 wherein the silicic acid is combined with the sodium silicate solution containing the anionic polyelectrolyte by generating the silicic acid in situ.

13. The method of claim 12 wherein the ratio of the anionic polyclectrolyte to the total silica is about 0.5 to about 10%.

14. An anionic nanocomposite for use as a retention and drainage aid in papermaking prepared by the process comprising the steps of:

a) providing a sodium silicate solution;

b) adding an anionic polyelectrolyte to the sodium silicate solution; and c) combining the sodium silicate solution containing the anionic polyelectrolyte with silicic acid.

15. The anionic nanocomposite of claim 14 wherein the anionic polyelectrolyte is selected from the group consisting of polysulfonates, polyacrylates and polyphosphonates.

16. The anionic nanocomposite of claim 15 wherein the anionic polyelectrolyte is naphthalene sulfonate formaldehyde condensate.

17. The anionic nanocomposite of claim 14 wherein the anionic polyelectrolyte has a molecular weight of from about 500 to about 1,000,000.

18. The anionic nanocomposite of claim 14 wherein the anionic polyelectrolyte has a molecular weight of from about 500 to about 300,000.

19. The anionic nanocomposite of claim 14 wherein the anionic polyelectrolyte has a molecular weight of from about 500 to about 120,000.

20. The anionic nanocomposite of claim 14 wherein the anionic polyelectrolyte has a charge density of from about 1 to about 13 milliequivalents/gram.

21. The anionic nanocomposite of claim 14 wherein the anionic polyelectrolyte has a charge density of from about 1 to about 5 milliequivalents/gram.

22. The anionic nanocomposite of claim 14 wherein the anionic polyelectrolye is added to the sodium silicate solution in an amount of from about 0.5 to about 15% by weight based on the total final silica concentration.

23. The anionic nanocomposite of claim 14 wherein the silicic acid is combined with the sodium silicate solution containing the anionic polyelectrolyte by adding the silicic acid to the solution.

24. The anionic nanocomposite of claim 23 wherein the ratio of the anionic polyelectrolyte to the total silica is about 0.5 to about 15%.

25. The anionic nanocomposite of claim 14 wherein the silicic acid is combined with the sodium silicate solution containing the anionic polyelectrolyte by generating the silicic acid in situ.

26. The anionic nanocomposite of claim 25 wherein the ratio of the anionic polyelectrolyte to the total silica is about 0.5 to about 10%.

* * * * *

UNITED STATES PATENT AND TRADEMARK OFFICE

CERTIFICATE OF CORRECTION

PATENT NO. : 6,083,997
DATED : July 4, 2000
INVENTOR(S) : Arthur James Begala and Bruce A. Keiser It is certified that error appears in the above-identified patent and that said Letters Patent is hereby corrected as shown below:

Column 19, claim 1,
Line 40, "anioinic polyelectrolyte with silicic acid." should read as -- anionic polyelectrolyte with silicic acid. --

Column 20, claim 13,
Line 26, "anionic polyclectrolyte" should read -- anionic polyelectrolyte --

Signed and Sealed this

Second Day of April, 2002

*Attest:*

*Attesting Officer*

JAMES E. ROGAN
*Director of the United States Patent and Trademark Office*